US012589937B2

(12) United States Patent
Sunder et al.

(10) Patent No.: US 12,589,937 B2
(45) Date of Patent: Mar. 31, 2026

(54) DETERGENT PRESENTATION PACK

(71) Applicant: HENKEL AG & CO. KGAA, Düsseldorf (DE)

(72) Inventors: Matthias Sunder, Düsseldorf (DE); Mareile Job, Leverkusen (DE); Marouane Jaafour, Willich (DE); Arno Düffels, Düsseldorf (DE); Steffen Ristau, Düsseldorf (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 0 days.

(21) Appl. No.: 18/280,235

(22) PCT Filed: Feb. 3, 2022

(86) PCT No.: PCT/EP2022/052561
§ 371 (c)(1),
(2) Date: Sep. 3, 2023

(87) PCT Pub. No.: WO2022/184369
PCT Pub. Date: Sep. 9, 2022

(65) Prior Publication Data

US 2024/0067444 A1 Feb. 29, 2024

(30) Foreign Application Priority Data

Mar. 3, 2021 (EP) ..... 21160371

(51) Int. Cl.
*B65D 85/62* (2006.01)
*B65D 5/02* (2006.01)
(Continued)

(52) U.S. Cl.
CPC ..... *B65D 85/62* (2013.01); *B65D 5/02* (2013.01); *B65D 75/002* (2013.01); *B65D 77/02* (2013.01); *B65D 85/54* (2013.01)

(58) Field of Classification Search
CPC ..... B65D 85/62; B65D 77/02; B65D 85/54; B65D 5/02; B65D 75/002
(Continued)

(56) References Cited

U.S. PATENT DOCUMENTS 4,996,000 A 2/1991 Redeker
2003/0136701 A1* 7/2003 Giblin ..... C11D 17/046 206/524.7
(Continued)

FOREIGN PATENT DOCUMENTS

DE 10018003 A1 10/2001
EP 979862 A1 * 2/2000 ..... C11D 17/0078
(Continued)

*Primary Examiner* — Rafael A Ortiz
(74) *Attorney, Agent, or Firm* — Blank Rome LLP

(57) ABSTRACT

A detergent presentation pack includes outer packaging in the form of a folding box, having a base surface, a cover surface and side walls connecting the base surface and the cover surface, and cuboidal detergent tablets with three different edge lengths and three 2-fold axes of rotation. The degree of filling of the outer packaging is from 85% by volume to 99% by volume, and the outer packaging contains at least two detergent tablets, which are arranged in the outer packaging such that the axes of rotation of the detergent tablets along which the latter have the lowest level of tablet hardness run parallel to the base surface of the outer packaging.

20 Claims, 3 Drawing Sheets

(51) Int. Cl.
*B65D 75/00* (2006.01)
*B65D 77/02* (2006.01)
*B65D 85/00* (2006.01)

(58) Field of Classification Search
USPC ..... 206/499, 524.6, 524.7
See application file for complete search history.

(56) References Cited

U.S. PATENT DOCUMENTS

| | | | | |
|---|---|---|---|---|
| 2005/0241980 | A1 | 11/2005 | Schmitt et al. | |
| 2011/0167745 | A1 | 7/2011 | Sondermann | |
| 2014/0274858 | A1 * | 9/2014 | Fausnight | C11D 1/835 510/242 |

FOREIGN PATENT DOCUMENTS

| | | | | |
|---|---|---|---|---|
| WO | 2004046297 | A1 | 6/2004 | |
| WO | WO-2004058580 | A1 * | 7/2004 | B65D 5/2019 |

* cited by examiner

DETERGENT PRESENTATION PACK

CROSS-REFERENCE TO RELATED APPLICATIONS

This application is a National Stage of International Patent Application No. PCT/EP2022/052561, filed Feb. 3, 2022, which claims priority to European Patent Application No. 21160371.7, filed Mar. 3, 2021, the disclosures of which are hereby incorporated by reference herein in their entireties.

FIELD OF THE INVENTION

The present invention relates to a detergent presentation pack comprising an outer packaging and detergent tablets which are arranged in a sorted manner in the outer packaging. In particular, the invention relates to detergent presentation packs which have assorted detergent tablets and outer packaging having high degrees of filling.

BACKGROUND

Continuously changing requirements are imposed on the forms of manufacture and supply of detergents and cleaning agents. The main focus has, for quite some time, been on the convenient metering of detergents and cleaning agents by the consumer and the simplification of the work steps necessary for carrying out a washing or cleaning method. A technical solution is provided by pre-portioned detergents or cleaning agent dosing units—for example, water-soluble containers having one or more receiving chambers for powdered or liquid detergents or cleaning agents. A further technical solution is offered by the detergent tablets which can be designed in one or more phases.

Both the water-soluble containers and the detergent tablets are generally hygroscopic, due to the active substances included therein. In order to prevent the water absorption, the pre-portioned detergent or cleaning agent dosing units are individually packaged by means of water-impermeable packaging means, for example flow packs based on water-insoluble polymer films. Alternatively, a plurality of washing or cleaning agent dosing units can be packaged in a container which in turn has a water vapor barrier and in this way reduces the water admission to the dosing units.

Regardless of whether the packaging means used to reduce the water ingress enclose individual washing or cleaning agent dosing units or a plurality of washing or cleaning agent dosing units, their use is undesirable for ecological reasons. An aim of the development of novel detergent presentation packs is therefore to provide packaging solutions and production forms which, on the basis of recycled or recyclable or biodegradable materials, as far as possible achieve the technical advantages of biologically non-recycled or non-recyclable or non-biodegradable materials. The optimization and development of already existing, sustainable technical solutions offers a starting point for this development.

A technical problem which has attracted particular attention with respect to washing or cleaning agent dosing units, in particular to washing or cleaning agent tablets, is that of ensuring the transport and storage stability of these dosing units. In this case, the term transport and storage stability includes both the assurance of the physical stability of the washing or cleaning agent dosing units, for example against breakage or abrasion, and also the assurance of the chemical stability of the washing or cleaning agent dosing units, for example against premature reaction and disintegration of the spatial form caused by reaction. A conventional approach for ensuring the transport and storage stability of washing or cleaning agent tablets consists in the packaging of these tablets by means of individual flow pack packaging having three-sided weld seams and the fin seams characteristic of these flow packs. These flow packs are generally produced from non-biodegradable, water-insoluble polymer films and, in addition to the washing or cleaning agent dosing unit, also enclose a considerable air volume. In the case of mechanical stress, this air volume and the above-mentioned fin seams ensure the physical integrity of the dosing units, due to their damping effect. In addition, the water-insoluble polymer films prevent unwanted ingress of water from the ambient air, and thus also chemically stabilize the washing or cleaning agent dosing units.

SUMMARY OF THE INVENTION

Against the background of the prior art described above, it was the object of the application to provide detergent portion units which can be produced by means of simplified methods, have a high transport and storage stability, and can be prepared in a simple manner using the smallest amounts of packaging supplies. Finally, the detergent portion units should have a high product capacity and be easy and safe for the consumer to handle.

DETAILED INVENTION

Figure 1:
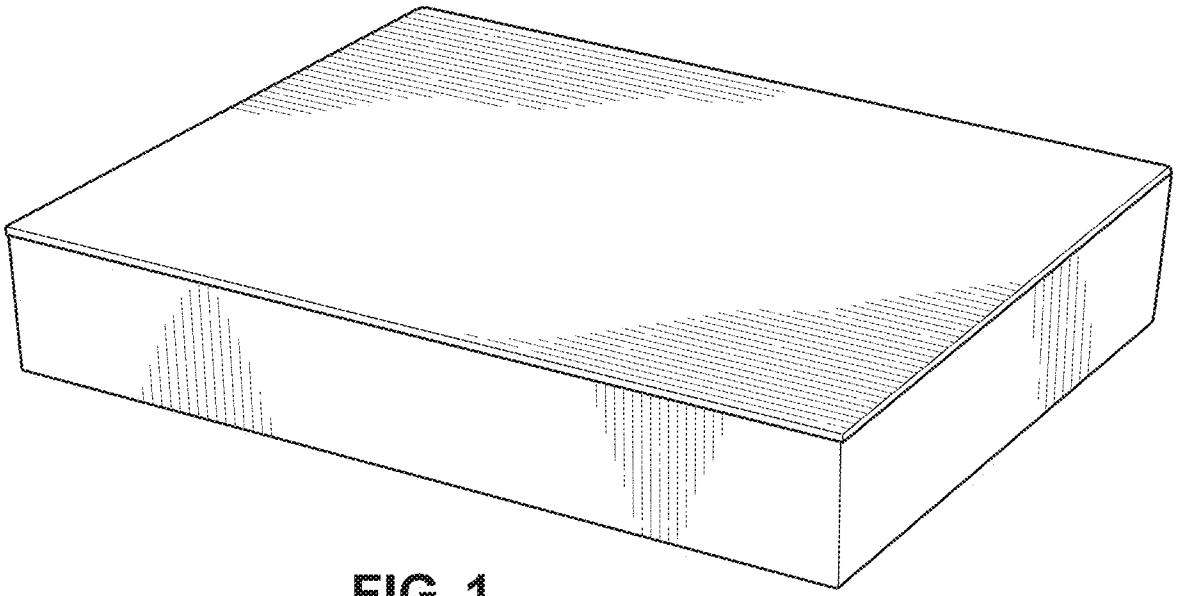
FIG. 1 illustrates an example of a closed outer packaging.
Figure 2:
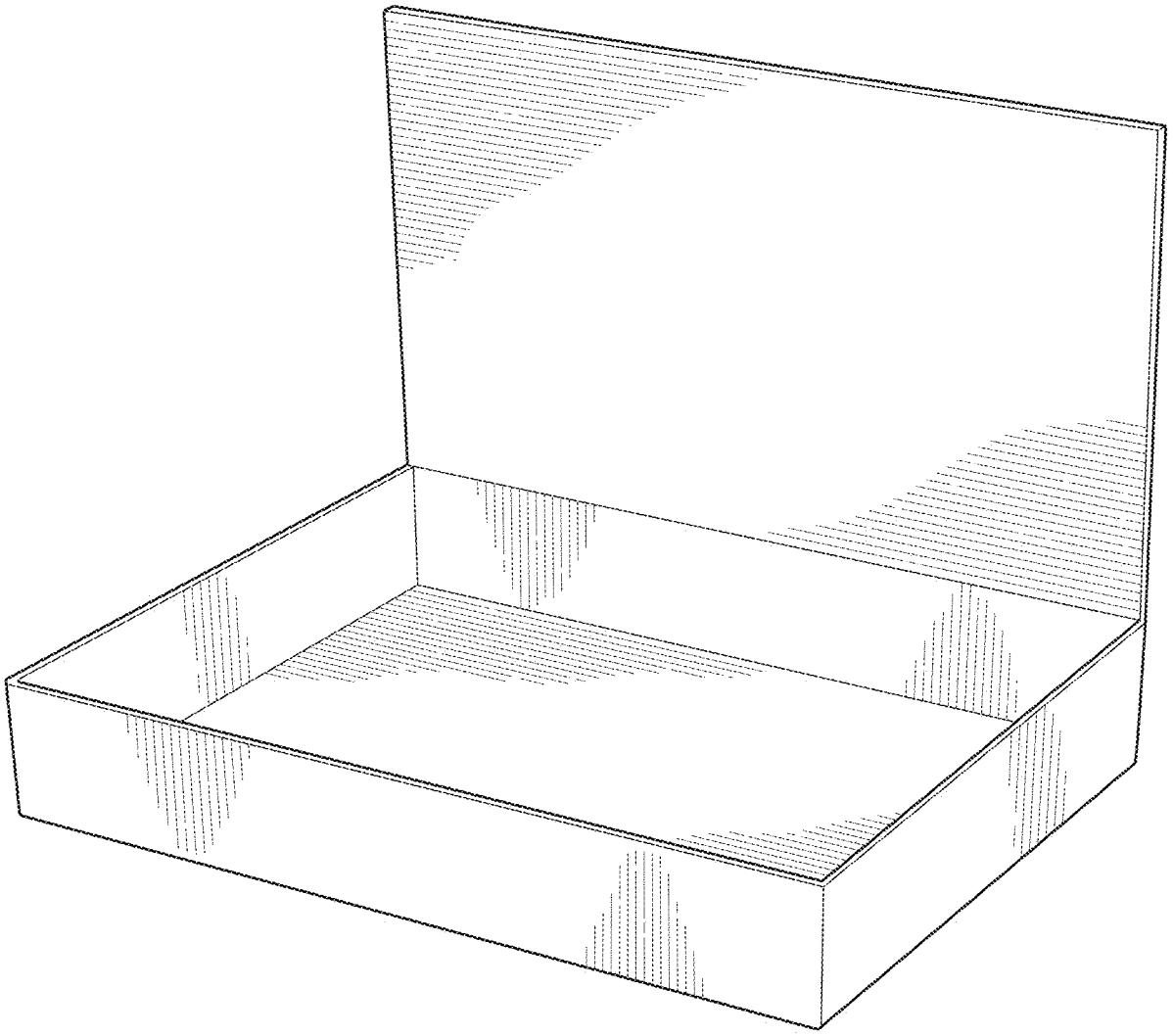
FIG. 2 illustrates an example of an open outer packaging.
Figure 3:
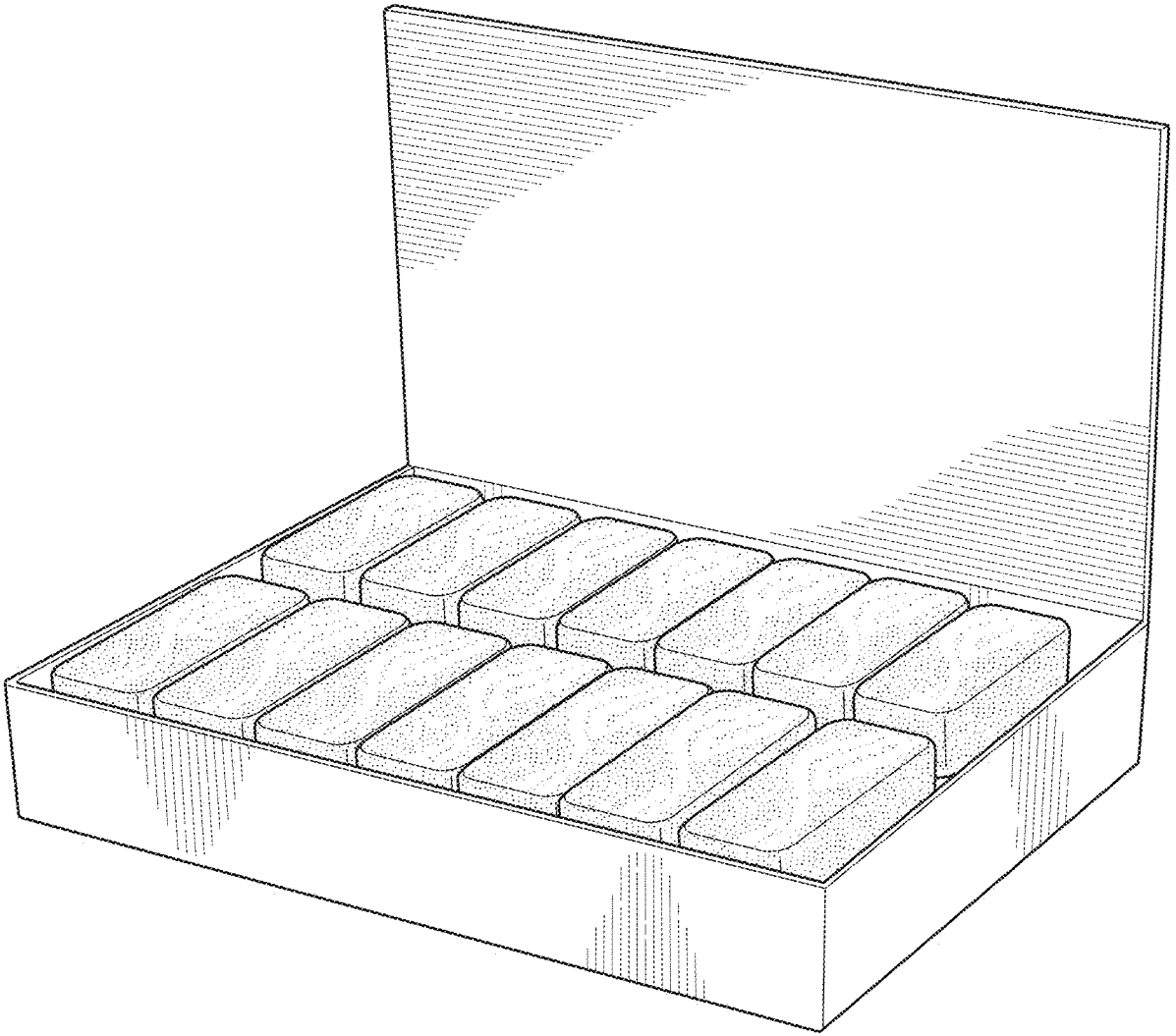
FIG. 3 illustrates an example of an open outer packaging including a plurality of cuboid detergent shaped bodies.

A detergent presentation pack, comprising the following, is suitable for achieving these objects:

a) an outer packaging in the form of a folding box, having a base surface, a cover surface, and side walls connecting the base surface and the cover surface, b) cuboidal detergent tablets having three different edge lengths and three 2-fold axes of rotation, wherein i) the outer packaging has a degree of filling of 85% by volume to 99% by volume, and ii) the outer packaging includes at least two detergent tablets which are arranged in the outer packaging such that the axes of rotation of the detergent tablets along which the latter have the lowest level of tablet hardness, extend in parallel with the base surface of the outer packaging.

Surprisingly, it has been found that, in outer packaging having a high degree of filling, the alignment of the detergent tablets characterizing the subject matter of the claim brings about an improvement in the storage and transport stability of these tablets.

The outer packaging is preferably designed as a single-piece folding box. Preferred outer packagings have a flat base surface, the largest diagonal of which is greater than the height of the outer packaging. This embodiment of the outer packaging increases its stability and enables simple opening and removal. It is particularly preferred if the outer packaging has flat base surfaces, the largest diagonal of which is more than twice, preferably more than four times, the height of the outer packaging.

In order to achieve the high degree of filling, it has proven advantageous for the outer packaging to have an angular base surface, preferably a quadrilateral base surface, very particularly preferably a rectangular base surface. For the same reason and for improving the stackability of the outer packagings, it is preferred that the outer packaging has a cover surface that is plane-parallel to the base surface. Outer packaging in cuboid form is particularly preferred.

For increasing the storage stability, in particular the chemical stabilization of the detergent tablets, it has proven advantageous for the outer packaging to be reclosable. Suitable closure elements are, for example, adhesive, latching, snap or plug elements, adhesive and plug elements being particularly preferred. Closure elements by way of example are plug-in closures or removable adhesive closures.

For reasons of sustainability, recycled and/or recyclable materials are preferred for the production of the outer packaging. The packaging materials are preferably based on renewable raw materials. The use of packaging materials based on pulp and waste paper is particularly preferred.

In a first preferred embodiment, the outer packaging is made of cardboard. In addition to its availability and recyclability, cardboard is advantageous due to the great variability of the available types and grammages. Preferred cardboards have a grammage of 150 to 400 g/m$^2$.

Corrugated cardboard, which has proven to be technically superior to cardboard in some respects, is used in a particularly preferred embodiment for manufacturing the outer packaging. Corrugated cardboard is characterized by a high strength with low intrinsic weight and is a suitable means for storage and transport, even in large containers.

A further significant technical advantage of the corrugated cardboard, in connection with the present invention, is its hollow volume. The design of the side walls of the outer packaging with inclusion of cavities has proven to be surprisingly advantageous for the physical stability of the detergent tablets. Preferably, at least one of the side walls has a hollow volume which is at least 10% by volume of the volume of the side wall. Further improved stabilization of the detergent tablets can be achieved if at least two of the side walls have hollow volumes which are at least 10% by volume of the volume of the respective side wall, it being particularly advantageous if two opposing side walls of the outer packaging have hollow volumes which are at least 10% by volume of the volume of the respective side wall. Very particular preference is given to detergent presentation packs in which all the side walls of the outer packaging have hollow volumes which are at least 10% by volume of the volume of the respective side wall.

Preferably, the detergent tablets are arranged in the outer packaging such that the axes of rotation of the detergent tablets, along which the latter have the lowest level of tablet hardness, are orthogonal to a side wall of the outer packaging which has a hollow volume which is at least 10% by volume of the volume of the side wall.

In addition to physical stability, the chemical stability of the detergent tablets is surprisingly also promoted by the integration of hollow volumes into the side walls of the outer packaging. A conceivable explanation is that the water ingress from the outside into the interior of the outer packaging is made more difficult by the hollow volume interrupting the material of the side walls, and/or the hollow volume in the side walls provides a buffer against moisture ingress.

For the aforementioned reasons, particularly preferred outer packagings have one or more side walls, in which the hollow volume is at least 20% by volume, preferably at least 40% by volume, of the volume of the respective side wall.

The hollow volume in the side walls of the outer packaging can be realized, for example, by using corrugated cardboard. A preferred alternative or supplement to the corrugated cardboard is offered by crimping boxes or hollow edge boxes which are suitable, due to their construction, to realize hollow volumes in the range of 10% by volume and higher.

An essential feature of the detergent presentation pack according to the invention is its high degree of filling of 85 to 99% by volume of the outer packaging. This high degree of filling not only reduces the amount of packaging material used per detergent tablet, but also surprisingly increases the physical stability of the detergent tablets, both with regard to the tablet breakage and with respect to the tablet abrasion. The degree of filling of preferred outer packagings is 88% by volume to 99% by volume, preferably 92% by volume to 99% by volume. The term "degree of filling" refers to that portion of the internal volume of the outer packaging which is occupied by the detergent tablets located in the outer packaging.

Detergent tablets refer both to presentation packs for textile laundry and to presentation packs for cleaning hard surfaces such as ceramics, glass, metal, or tiles. Particular preference is given to detergent tablets for textile laundry since these are generally distinguished by a comparatively low level of tablet hardness due to the necessity of rapid disintegration in the washing liquor. The detergent tablets preferably have a weight of 14 g to 42 g, preferably of 20 g to 38 g, in particular of 24 g to 34 g.

Due to its manufacturability and its properties for removal from the outer packaging, detergent tablets which have a flat underside, the largest diagonal of which is more than twice, preferably more than four times, the height of the detergent tablet, are preferred.

The cuboidal detergent tablets are arranged in the outer packaging such that the axes of rotation of the detergent tablets, along which the latter have the lowest level of tablet hardness, extend in parallel with the base surface of the outer packaging. This type of arrangement is advantageous particularly in the case of cuboid detergent tablets which have three 2-fold axes of rotation, the levels of tablet hardness which the detergent tablets have along these three axes of rotation differing from one another. In preferred embodiments, the cuboidal detergent tablets have three 2-fold axes of rotation, and the lowest level of tablet hardness, which the detergent tablets have along one of these three axes of rotation, is at least 20%, preferably at least 40%, and in particular at least 60%, below the next highest level of tablet hardness along one of the two remaining axes of rotation.

The levels of tablet hardness which the cuboidal detergent tablets have along their three 2-fold axes of rotation are preferably from 50 N to 300 N, preferably from 70 N to 200 N. The lowest level of tablet hardness, which the detergent tablets have along one of their three axes of rotation, is preferably in the range from 50 N to 150 N, preferably from 60 N to 130 N. The hardness of the tablets is measured by deformation of the tablet until fracture, the force acting on the side surfaces of the tablet and the maximum force that the tablet withstands being determined. In order to determine the level of tablet hardness, a tablet testing apparatus from the company Sotax is suitable, for example.

It has also proven advantageous for the stability of the tablets if the edges delimiting the underside and the upper side are chamfered. In order to increase the stability of the tablets, it may furthermore be advisable to round the edges of the lateral surfaces connecting the undersides and the upper sides.

The density of preferred detergent tablets is 1.1 g/cm$^3$ to 1.5 g/cm$^3$, preferably 1.15 g/cm$^3$ to 1.3 g/cm$^3$. As a consequence of the high tablet density and the high degree of filling, the detergent presentation packs according to the invention have comparatively high densities, for example densities in the range of 0.9 g/cm$^3$ to 1.4 g/cm$^3$, preferably in the range of 1.05 g/cm$^3$ to 1.3 g/cm$^3$.

Preferred detergent tablets have a rough upper side or a rough underside, the average roughness of which is from 25 μm to 1000 μm, preferably from 50 μm to 800 μm. The roughness describes the deviation of a real surface from an ideally smooth surface, and is determined, for example, by means of confocal laser scanning microscopy.

The roughness values preferred according to the invention reduce the abrasion of the tablets during production and transport, and at the same time ensure sufficient adhesion of the tablets to the material of the outer packaging and the other tablets located in the outer packaging, thereby stabilizing them within the outer packaging.

In order to improve the tablet integrity, the detergent tablets can have film packaging, wherein it is particularly preferred if each of the detergent tablets has a separate film packaging.

If film packaging is used, film packaging made of a water-soluble film material is preferred. The water-soluble film material may comprise one or more structurally different water-soluble polymer(s). Suitable water-soluble polymer(s) are in particular polymers from the group of (optionally acetalized) polyvinyl alcohols (PVAL) and copolymers thereof.

Water-soluble film materials are preferably based on a polyvinyl alcohol or a polyvinyl alcohol copolymer of which the molecular weight is in the range of from 10,000 to 1,000,000 gmol$^{-1}$, preferably from 20,000 to 500,000 gmol$^{-1}$, particularly preferably from 30,000 to 100,000 gmol$^{-1}$, and in particular from 40,000 to 80,000 gmol$^{-1}$.

The production of the polyvinyl alcohol and polyvinyl alcohol copolymers generally includes the hydrolysis of intermediate polyvinyl acetate. Preferred polyvinyl alcohols and polyvinyl alcohol copolymers have a degree of hydrolysis of 70 to 100 mol. %, preferably 80 to 90 mol. %, particularly preferably 81 to 89 mol. %, and in particular 82 to 88 mol. %.

Preferred polyvinyl alcohol copolymers include, in addition to vinyl alcohol, an ethylenically unsaturated carboxylic acid, or the salt or ester thereof. In addition to vinyl alcohol, such polyvinyl alcohol copolymers particularly preferably include sulfonic acids, such as 2-acrylamido-2-methyl-1-propanesulfonic acid (AMPS), acrylic acid, methacrylic acid, acrylic esters, methacrylic esters or mixtures thereof; among the esters, preference is given to C1-4 alkyl ester or hydroxyalkyl esters. Ethylenically unsaturated dicarboxylic acids, for example itaconic acid, maleic acid, fumaric acid and mixtures thereof, are possible as further monomers.

Due to their availability, simple processability and biodegradability, film packaging is preferred which consists of at least 40% by weight, preferably at least 60% by weight and in particular at least 80% by weight of polyvinyl alcohol.

In order to increase the tablet stability and to ensure a sufficient degree of filling in the outer packaging, it is preferred to shrink the film packaging onto the detergent tablets.

For reasons of the sustainable design of the detergent presentation pack, it may be advisable to dispense with a film packaging for the detergent tablets.

In fact, the detergent tablets in the detergent presentation packs according to the invention have proven to be unexpectedly stable. This also applies in particular to detergent tablets which tend to exhibit reduced transport and storage stability due to their hygroscopicity, for example due to the integration of tablet disintegrants.

Detergent tablets which are particularly preferably suitable for packaging in the detergent presentation packs according to the invention are in particular detergent tablets which have a water absorption (2 weeks, 35° C., 80% relative humidity) above 20 mg/g, preferably above 30 mg/g.

Furthermore, detergent tablets which have a volume expansion (2 weeks, 35° C., 80% relative humidity) above 5% by volume, preferably above 7% by volume and in particular from 8% by volume to 18% by volume, are suitable for packaging in the detergent presentation packs. This type of increase in volume can be observed, for example, in detergent tablets which include a disintegration aid, in particular a polymeric disintegration aid, for example a disintegration aid based on polyvinyl pyrrolidone or cellulose.

In order to reduce the packaging fraction per laundry detergent tablet, it is preferred if the detergent presentation pack comprises at least ten, preferably at least twenty, particularly preferably at least thirty, detergent tablets which are arranged in the outer packaging such that the axis of rotation of the detergent tablets, along which they have the lowest level of tablet hardness, extends in parallel with the base surface of the outer packaging.

In the case of the integration of a larger number of detergent tablets into the detergent presentation pack, a purposeful arrangement of the tablets can further improve the stability thereof. Detergent presentation packs have proven advantageous which comprise at least ten, preferably at least twenty, particularly preferably at least thirty detergent tablets, which are arranged in the outer packaging in an assorted manner, such that each of the detergent tablets is in direct contact with at least three further detergent tablets.

Furthermore, embodiments are advantageous in which the detergent presentation pack comprises at least ten, preferably at least twenty, particularly preferably at least thirty, detergent tablets which are arranged in the outer packaging such that the axis of rotation of the detergent tablets, along which they have the lowest level of tablet hardness, extend in parallel with the base surface of the outer packaging and this axis of rotation coincides with at least one axis of rotation of the lowest level of tablet hardness of a detergent tablet in direct contact.

The detergent presentation packs according to the invention are suitable for sale as a finished product in stationary retail or on digital marketplaces on the Internet, due to their packaging. The transport and storage of these finished products in intermediate storage locations necessary for distribution generally does not take place in the form of individual detergent presentation packs, but rather a plurality of these detergent presentation packs are combined in a common container. The transport and storage stability of the detergent tablets can also advantageously be influenced in these containers by a purposeful orientation of the detergent presentation packs. In particular, those containers have proven advantageous which a) comprise transport packaging having a base surface, a cover surface, and side walls connecting the base surface and the cover surface, and b) at least two detergent presentation packs according to the invention, wherein i) the detergent presentation packs are arranged in the transport packaging such that the axes of rotation of the detergent tablets contained in the detergent presentation packs, along which the latter have the lowest level of tablet hardness, extend in parallel with the base surface of the transport packaging.

In preferred embodiments, the containers comprise at least ten, preferably at least twenty, and in particular at least forty, of the detergent presentation packs according to the invention.

In summary, this application provides, inter alia, the following subject matter:

1. Detergent presentation pack, comprising a) an outer packaging in the form of a folding box, having a base surface, a cover surface, and side walls connecting the base surface and the cover surface, b) cuboidal detergent tablets having three different edge lengths and three 2-fold axes of rotation, wherein i) the outer packaging has a degree of filling of 85% by volume to 99% by volume, and ii) the outer packaging contains at least two washing tablets which are arranged in the outer packaging such that the axes of rotation of the detergent tablets, along which the latter have the lowest level of tablet hardness, extend in parallel with the base surface of the outer packaging.

2. Detergent presentation pack according to item 1, wherein the outer packaging has a flat base surface, the largest diagonal of which is greater than the height of the outer packaging.

3. Detergent presentation pack according to either of the preceding points, wherein the outer packaging has a flat base surface, the largest diagonal of which is more than twice, preferably more than four times, the height of the outer packaging.

4. Detergent presentation pack according to any of the preceding points, wherein the outer packaging has an angular base surface, preferably a quadrilateral base surface, very particularly preferably a rectangular base surface.

5. Detergent presentation pack according to any of the preceding points, wherein the outer packaging has a cover surface in parallel with the base surface.

6. Detergent presentation pack according to any of the preceding points, wherein the outer packaging is cuboidal in shape.

7. Detergent presentation pack according to any of the preceding points, wherein the outer packaging is reclosable.

8. Detergent presentation pack according to any of the preceding points, wherein the outer packaging is made of cardboard.

9. Detergent presentation pack according to any of the preceding points, wherein the outer packaging is made of corrugated cardboard.

10. Detergent presentation pack according to any of the preceding points, wherein at least one of the side walls of the outer packaging has a hollow volume which is at least 10% by volume of the volume of the side wall.

11. Detergent presentation pack according to any of the preceding points, wherein at least two of the side walls of the outer packaging have hollow volumes which are 10% by volume of the volume of the respective side wall.

12. Detergent presentation pack according to any of the preceding points, wherein at least two opposing side walls of the outer packaging have hollow volumes which are at least 10% by volume of the volume of the respective side wall.

13. Detergent presentation pack according to any of the preceding points, wherein all side walls of the outer packaging have hollow volumes which are at least 10% by volume of the volume of the respective side wall.

14. Detergent presentation pack according to any of the preceding points, wherein the axes of rotation of the detergent tablets, along which the latter have the lowest level of tablet hardness, are orthogonal to a side wall of the outer packaging which has a hollow volume which is at least 10% by volume of the volume of the side wall.

15. Detergent presentation pack according to any of points 11 to 14, wherein the hollow volume is at least 20% by volume, preferably at least 40% by volume, of the volume of the respective side wall.

16. Detergent presentation pack according to any of the preceding points, wherein the outer packaging is designed as a crimping box.

17. Detergent presentation pack according to any of the preceding points, wherein the outer packaging is designed as a hollow edge box.

18. Detergent presentation pack according to any of the preceding points, wherein the outer packaging has a degree of filling of 88% by volume to 99% by volume, preferably 92% by volume to 99% by volume.

19. Detergent presentation pack according to any of the preceding points, wherein the detergent tablets have a weight of 14 g to 42 g, preferably of 20 g to 38 g, and in particular of 24 g to 34 g.

20. Detergent presentation pack according to any of the preceding points, wherein the detergent tablets have a flat underside, the largest diagonal of which is more than twice, preferably more than four times, the height of the detergent tablet.

21. Detergent presentation pack according to any of the preceding points, wherein the cuboidal detergent tablets have three 2-fold axes of rotation and the levels of tablet hardness, which the detergent tablets have along these three axes of rotation, differ from one another.

22. Detergent presentation pack according to any of the preceding points, wherein the cuboidal detergent tablets have three 2-fold axes of rotation, and the lowest level of tablet hardness, which the detergent tablets have along one of these three axes of rotation, is at least 20%, preferably at least 40%, and in particular at least 60% below the next highest level of tablet hardness along one of the two remaining axes of rotation.

23. Detergent presentation pack according to any of the preceding points, wherein the cuboidal detergent tablets have three 2-fold axes of rotation, and the levels of tablet hardness which the detergent tablets have along these three axes of rotation are from 50 N to 300 N, preferably from 70 N to 200 N.

24. Detergent presentation pack according to any of the preceding points, wherein the cuboidal detergent tablets have three 2-fold axes of rotation, and the lowest level of tablet hardness, which the detergent tablets have along one of these three axes of rotation, is from 50 N to 150 N, preferably from 60 N to 130 N.

25. Detergent presentation pack according to any of the preceding points, comprising cuboidal detergent tablets having an underside, an upper side and a lateral surface connecting the underside and the upper side, the edges delimiting the underside and the upper side being chamfered.
26. Detergent presentation pack according to any of the preceding points, comprising cuboidal detergent tablets having an underside, an upper side and a lateral surface connecting the underside and the upper side, wherein the edges of the lateral surfaces connecting the undersides and the upper sides are rounded.
27. Detergent presentation pack according to any of the preceding points, wherein the detergent tablets have a density of 1.1 g/cm$^3$ to 1.5 g/cm$^3$, preferably of 1.15 g/cm$^3$ to 1.3 g/cm$^3$.
28. Detergent presentation pack according to any of the preceding points, wherein the detergent product form has a density of 0.9 g/cm$^3$ to 1.4 g/cm$^3$, preferably from 1.05 g/cm$^3$ to 1.3 g/cm$^3$.
29. Detergent presentation pack according to any of the preceding points, wherein the detergent tablets have a rough upper side or a rough underside, the average roughness of which is from 25 μm to 1000 μm, preferably from 50 μm to 800 μm.
30. Detergent presentation pack according to any of the preceding points, wherein the detergent tablets have a film packaging.
31. Detergent presentation pack according to any of the preceding points, wherein each of the detergent tablets has a separate film packaging.
32. Detergent presentation pack according to any of the preceding points, wherein the detergent tablets have a film packaging made of a water-soluble film material.
33. Detergent presentation pack according to any of the preceding points, wherein the detergent tablets have a film packaging which consists of at least 40% by weight, preferably at least 60% by weight, and in particular at least 80% by weight of polyvinyl alcohol.
34. Detergent presentation pack according to any of the preceding points, wherein the detergent tablets have a film packaging which is shrunk onto the detergent tablets.
35. Detergent presentation pack according to any of the preceding points, wherein the detergent tablets do not have any film packaging.
36. Detergent presentation pack according to any of the preceding points, wherein the detergent tablets have a water absorption (2 weeks, 35° C., 80% relative humidity) above 20 mg/g, preferably above 30 mg/g.
37. Detergent presentation pack according to any of the preceding points, wherein the detergent tablets have a volume expansion (2 weeks, 35° C., 80% relative humidity) above 5% by volume, preferably above 7% by volume, and in particular from 8% by volume to 18% by volume.
38. Detergent presentation pack according to any of the preceding points, wherein the detergent tablets contain a disintegration aid, preferably a polymeric disintegration aid, particularly preferably a disintegration aid based on polyvinyl pyrrolidone or cellulose.
39. Detergent presentation pack according to any of the preceding points, wherein the detergent presentation pack comprises at least ten, preferably at least twenty, particularly preferably at least thirty, detergent tablets which are arranged in the outer packaging such that the axis of rotation of the detergent tablets, along which the latter have the lowest level of tablet hardness, extends in parallel with the base surface of the outer packaging.
40. Detergent presentation pack according to any of the preceding points, wherein the Detergent presentation pack comprises at least ten, preferably at least twenty, particularly preferably at least thirty, detergent tablets, which are arranged in the outer packaging in an assorted manner, such that each of the detergent tablets is in direct contact with at least three further detergent tablets.
41. Detergent presentation pack according to any of the preceding points, wherein the detergent presentation pack comprises at least ten, preferably at least twenty, particularly preferably at least thirty, detergent tablets, which are arranged in the outer packaging such that the axis of rotation of the detergent tablets, along which the latter have the lowest level of tablet hardness, extends in parallel with the base surface of the outer packaging, and this axis of rotation coincides with at least one axis of rotation of the lowest level of tablet hardness of a detergent tablet in direct contact.
42. Container, comprising
   a) a transport packaging having a base surface, a cover surface, and side walls connecting the base surface and the cover surface,
   b) at least two detergent presentation packs according to any of the preceding points, wherein
      i) the detergent presentation packs are arranged in the transport packaging such that the axes of rotation of the detergent tablets contained in the detergent presentation packs, along which the latter have the lowest level of tablet hardness, extend in parallel with the base surface of the transport packaging.
43. Container according to point 42, wherein the container comprises at least ten, preferably at least twenty, and in particular at least forty, of the detergent presentation packs.

The invention claimed is:

1. A detergent presentation pack, comprising:

an outer packaging having a base surface, a cover surface, and side walls connecting the base surface and the cover surface; and a plurality of cuboidal detergent tablets in a sorted arrangement within the outer packaging, each of the plurality of cuboidal detergent tablets having a first twofold axis of rotation in parallel with a first edge having a first edge length, a second twofold axis of rotation in parallel with a second edge having a second edge length, and a third twofold axis of rotation in parallel with a third edge having a third edge length, the first edge length, the second edge length, and the third edge length being different from one another, wherein:

the plurality of cuboid detergent tablets fill from 85% by volume to 99% by volume of the volume of the outer packaging, based on the total volume of the outer packaging, each of the plurality of cuboid detergent tablets has a first tablet hardness along the first twofold axis of rotation, a second tablet hardness along the second twofold axis of rotation, and a third tablet hardness along the third twofold axis of rotation, the first tablet hardness, the second tablet hardness, and the third tablet hardness being different from one another such that the first tablet hardness is at least 20% below the second tablet hardness and the third tablet hardness, and at least two of the plurality of cuboidal detergent tablets are arranged such that the first edge in parallel with the first twofold axis of rotation of each of the at least two cuboidal detergent tablets is in parallel with the base surface of the outer packaging.

2. The detergent presentation pack of claim 1, wherein the outer packaging is made of cardboard.

3. The detergent presentation pack of claim 2, wherein the outer packaging is made of corrugated cardboard.

4. The detergent presentation pack of claim 3, wherein at least one side wall of the outer packaging has a hollow volume which is at least 10% by volume of the volume of the side wall.

5. The detergent presentation pack of claim 1, wherein the first tablet hardness is from 50 N to 150 N.

6. The detergent presentation pack of claim 1, wherein each of the plurality of cuboidal detergent tablets is covered by a film that is shrunk onto each of the cuboidal detergent tablets.

7. The detergent presentation pack of claim 1, wherein the plurality of cuboidal detergent tablets have a water absorption above 20 mg/g at 2 weeks, 35° C., and 80% relative humidity.

8. The detergent presentation pack of claim 1, wherein the plurality of cuboidal detergent tablets have a volume expansion above 5% by volume at 2 weeks, 35° C., and 80% relative humidity.

9. The detergent presentation pack of claim 1, wherein the first tablet hardness is at least 40% below the second tablet hardness and the third tablet hardness.

10. The detergent presentation pack of claim 9, wherein the first tablet hardness is at least 60% below the second tablet hardness and the third tablet hardness.

11. The detergent presentation pack of claim 5, wherein the first tablet hardness is from 60 N to 130 N.

12. The detergent presentation pack of claim 6, wherein the film comprises a polyvinyl alcohol or a copolymer of polyvinyl alcohol.

13. The detergent presentation pack of claim 7, wherein the water absorption of the plurality of cuboidal detergent tablets is above 30 mg/g at 2 weeks, 35° C., and 80% relative humidity.

14. The detergent presentation pack of claim 8, wherein the volume expansion of the plurality of cuboidal detergent tablets is above 7% by volume at 2 weeks, 35° C., and 80% relative humidity.

15. The detergent presentation pack of claim 14, wherein the volume expansion of the plurality of cuboidal detergent tablets is above 8% by volume at 2 weeks, 35° C., and 80% relative humidity.

16. The detergent presentation pack of claim 15, wherein the volume expansion of the plurality of cuboidal detergent tablets is above 18% by volume at 2 weeks, 35° C., and 80% relative humidity.

17. The detergent presentation pack of claim 1, wherein the first edge is perpendicular to the second edge and perpendicular to the third edge.

18. The detergent presentation pack of claim 1, wherein:

at least four of the plurality of cuboidal detergent tablets are arranged in the outer packaging such that at least one of the at least four cuboidal detergent tablets is in direct contact with at least three of the at least four cuboidal detergent tablets, and the first twofold axis of rotation of each of the at least four cuboidal detergent tablets extends in parallel with the base surface of the outer packaging.

19. The detergent presentation pack of claim 1, wherein at least two of the plurality of cuboidal detergent tablets are arranged such that the first edge in parallel with the first twofold axis of rotation of each of the at least two cuboidal detergent tablets is on the base surface of the outer packaging.

20. A detergent presentation pack, comprising:

an outer packaging having a base surface, a cover surface, and side walls connecting the base surface and the cover surface; and a plurality of cuboidal detergent tablets within the outer packaging, each of the plurality of cuboidal detergent tablets having three different edge lengths and three axes of rotation, and each of the plurality of cuboidal detergent tablets having a water absorption above 20 mg/g at 2 weeks, 35° C., and 80% relative humidity, wherein:

the plurality of cuboid detergent tablets dies fill from 85% by volume to 99% by volume of the volume of the outer packaging, based on the total volume of the outer packaging, a tablet hardness along each of the three axes of rotation is different from one another, and the outer packaging includes at least two cuboidal detergent tablets arranged such that the axis of rotation of the at least two cuboidal detergent tablets associated with the lowest tablet hardness extend in parallel with the base surface of the outer packaging.

* * * * *